US007756445B2

(12) United States Patent
Lee et al.

(10) Patent No.: US 7,756,445 B2
(45) Date of Patent: Jul. 13, 2010

(54) TRANSFER UNIT-FIXING APPARATUS AND IMAGE FORMING DEVICE HAVING THE SAME

(75) Inventors: Jin-soo Lee, Suwon-si (KR); Se-hyun Lyu, Seoul (KR); Heung-sup Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 878 days.

(21) Appl. No.: 11/434,138

(22) Filed: May 16, 2006

(65) Prior Publication Data

US 2007/0110476 A1 May 17, 2007

(30) Foreign Application Priority Data

Nov. 14, 2005 (KR) ..... 10-2005-0108741

(51) Int. Cl.
*G03G 15/08* (2006.01)

(52) U.S. Cl. ..... 399/121; 399/125; 399/302; 399/308

(58) Field of Classification Search ..... 399/121, 399/107, 109–110, 125, 302, 308
See application file for complete search history.

(56) References Cited

U.S. PATENT DOCUMENTS 4,403,851 A * 9/1983 Yanagawa ..... 399/125
4,634,264 A * 1/1987 Takahashi ..... 399/116
5,671,466 A * 9/1997 Hokamura et al. ..... 399/124
5,802,427 A * 9/1998 Sawada et al. ..... 399/122
5,930,564 A * 7/1999 Ookaji ..... 399/125
6,785,492 B2 * 8/2004 Tanizaki et al. ..... 399/113
7,349,648 B2 * 3/2008 Rennick et al. ..... 399/110
2005/0201782 A1 * 9/2005 Fuchiwaki et al. ..... 399/316
2006/0291901 A1 * 12/2006 Hiroe et al. ..... 399/121
2009/0022514 A1 * 1/2009 Fujiwara et al. ..... 399/121

FOREIGN PATENT DOCUMENTS

JP 2000-231321 8/2000
JP 2002-062781 2/2002
JP 2004-020574 1/2004
KR 1997-062827 9/1997

* cited by examiner

*Primary Examiner*—David M Gray
*Assistant Examiner*—Geoffrey T Evans
(74) *Attorney, Agent, or Firm*—Roylance, Abrams, Berdo & Goodman, L.L.P.

(57) ABSTRACT

A transfer unit-fixing apparatus to integrally fix a transfer unit on a door, and an image forming device having the same are disclosed. The transfer unit-fixing apparatus includes a position fixing unit to pivotally support a first part of the transfer unit on the door and a locking unit to lock a second part of the transfer unit to the door. The transfer unit can be easily assembled and disassembled to and from the door by the position fixing unit and the locking unit, and thus the image forming device can be easily assembled, maintained and repaired.

26 Claims, 10 Drawing Sheets

TRANSFER UNIT-FIXING APPARATUS AND IMAGE FORMING DEVICE HAVING THE SAME

CROSS REFERENCE TO RELATED APPLICATIONS

This application claims the benefit under 35 U.S.C. §119(a) of Korean Patent Application No. 2005-108741, filed on Nov. 4, 2005, in the Korean Intellectual Property Office, the entire contents of which are hereby incorporated by reference.

BACKGROUND OF THE INVENTION

1. Field of the Invention

The present invention relates to an image forming device such as a laser printer, a digital photocopier and the like. More particularly, the present invention relates to a transfer unit-fixing apparatus to integrally fix a transfer unit to a door of an image forming device, and an image forming device having the transfer unit-fixing apparatus.

2. Description of the Related Art

In general, an image forming device such as an electrophotographic tandem color image forming device has a plurality of developing units and a plurality of photosensitive body units disposed in parallel. Each of the plurality of photosensitive body units has a photosensitive body to form a toner image of a particular color, such as yellow, magenta, cyan and black, which is developed by a corresponding one of the plurality of developing units. A transfer unit transfers the toner images formed on the photosensitive bodies onto a recording medium, such as a sheet of printing paper, and a fusing unit fuses and fixes the toner images transferred onto the recording medium with heat and pressure.

Another type of tandem color image forming device further comprises an intermediate transfer unit having a transfer drum or a transfer belt disposed between the photosensitive bodies and the transfer unit. In this case, the toner images formed on the photosensitive bodies are not directly transferred to the recording medium, but instead are first transferred onto the transfer belt and then retransferred from the transfer belt onto the recording medium.

Tandem color image forming devices having a plurality of photosensitive body units that form a required image by simultaneously revolving the plurality of photosensitive bodies are advantageous in that they can produce color images at high speeds, as compared with a color image forming device that has a single photosensitive body unit that forms a required image by revolving a single photosensitive body several times. The construction of an apparatus with a plurality of photosensitive body units and developing units is complicated, however, and it is preferable that a tandem color image forming device is easily assembled, maintained and repaired.

Accordingly, a tandem color image forming device, for example a tandem color laser printer 1 as illustrated in FIG. 1, generally does not have separate photosensitive body units 22 and corresponding developing units 28. Instead, the photosensitive body units 22 and corresponding developing units 28 are contained in a plurality of cartridges 11Y, 11M, 11C, 11K. In other words, the components are modular so that they can be mounted in or removed from a cartridge frame 29 of a main body 10 as a single cartridge unit.

Also, as illustrated in FIGS. 1 and 2, a transfer unit 17 is integrally formed with a door 19 to be movable therewith, and is provided with a transfer belt or a medium conveying belt 18. The medium conveying belt 18 contacts the photoconductive bodies 14 of the photosensitive body units 22 in the plurality of cartridges 11Y, 11M, 11C, 11K when the door 19 is moved from the open position illustrated in FIG. 2 to the closed position illustrated in FIG. 2 by being rotated about a rotation axis 23.

However, in the conventional tandem color laser printer 1 as constructed above, the transfer unit 17 is fixed and assembled to the door 19 by fixing means such as screws, and therefore is integrally formed with the door 19. Thus, when the transfer unit 17 is assembled to the door 19 during manufacturing, fixing operations are required. These fixing operations may be problematic and require considerable time during assembly.

Also, to form a uniform image, it is important that the medium conveying belt 18 is maintained in contact with the photoconductive bodies 14 of the photosensitive body units 22 in the plurality of cartridges 11Y, 11M, 11C, 11K at a predetermined pressure to form predetermined nips therebetween. However, the conventional tandem color laser printer 1 is usually configured so that the cartridges 11Y, 11M, 11C, 11K mounted in a cartridge frame 29 and the transfer unit 17 fixed to the door 19 come in contact with each other when the door 19 is closed. Thus, if the cartridge frame 29 and the door 19 are not accurately manufactured due to manufacturing tolerances and the like, or are twisted due to contractions or expansions caused by external forces or changes in the environment, the medium conveying belt 18 may not contact the photoconductive bodies 14 at the appropriate predetermined pressure and therefore may not properly form the predetermined nips. Also, during image forming operation, the process speed of the cartridges 11Y, 11M, 11C, 11K and the transfer unit 17 may change. In this case, when toner images are transferred in turn onto a recording medium P from the photoconductive bodies 14 by the medium conveying belt 18 of the transfer unit 17, image defects such as jitter, mis-registration, skew and the like may be produced on the resultant image formed on the recording medium P.

Also, the conventional tandem color laser printer 1 is not provided with a separate relative position fixing means to maintain a fixed relative position between the cartridges 11Y, 11M, 11C, 11K and the transfer unit 17. Instead, the relative position between the cartridges 11Y, 11M, 11C, 11K and the transfer unit 17 is determined by a locking means (not shown) which locks the door 19 to a main body 10.

Accordingly, if the door 19 having the transfer unit 17 assembled thereto, or the locking means for locking the door 19 to the main body 10, are not accurately manufactured due to manufacturing tolerances and the like, the fixing position of the transfer unit 17 is directly affected, and therefore the transfer unit 17 may not be arranged at the proper position. Also, if during the image forming operation of the printer, a force is imparted on the door 19 by an external source, or vibration is generated by the cartridges 11Y, 11M, 11C, 11K and the transfer unit 17, the transfer unit 17 is directly affected. In this case, the position of the transfer unit 17 relative to the cartridges 11Y, 11M, 11C, 11K may change, and image defects such as jitter, mis-registration, skew and the like may be produced on the resultant image formed on the recording medium P.

Accordingly, there is a need for an improved apparatus for fixing a transfer unit to a door.

SUMMARY OF THE INVENTION

An aspect of the present invention is to address at least the above problems and/or disadvantages and to provide at least the advantages described below. Accordingly, an aspect of the present invention is to provide a transfer unit-fixing apparatus that can easily assemble and disassemble a transfer unit to and from a door, and an image forming device having the same.

Another aspect of the present invention is to provide a transfer unit-fixing apparatus that can maintain a medium conveying belt of a transfer unit to be in contact with photoconductive bodies of photosensitive body units in a plurality of cartridges at a predetermined pressure and thereby to form predetermined nips therebetween, even though a cartridge frame having the photosensitive body units mounted therein and a door having the transfer unit assembled thereto are not accurately manufactured due to manufacturing tolerances and the like, or are twisted due to contractions or expansions caused by external forces or changes in the environment, and an image forming device having the same.

Still another aspect of the present invention is to provide a transfer unit-fixing apparatus that can stably maintain a transfer unit at a fixed position relative to photosensitive body units in a plurality of cartridges even though a door and the like is not accurately manufactured due to manufacturing tolerances and the like, or due to external forces or vibrations generated by external or internal sources during image forming operations, and an image forming device having the same.

In accordance with an aspect of the present invention, a transfer unit-fixing apparatus of an image forming device for integrally fixing a transfer unit to a door comprises a position fixing unit for pivotally supporting and mounting a first part of the transfer unit on the door, and a locking unit for locking a second part of the transfer unit to the door.

The position fixing unit may include at least one fixing boss disposed on the first part of the transfer unit, and at least one mount disposed on the door for receivably and rotatably supporting the fixing boss. The mount may be a U-shaped member with a hinge groove. The hinge groove may have anti-escape projections formed at an inlet thereof to prevent the fixing boss from escaping from the hinge groove.

The locking unit may include at least one hook disposed on the door, and at least one hook hanger disposed opposite the hook on the second part of the transfer unit.

The transfer unit-fixing apparatus may further comprise a movable support unit for elastically supporting the transfer unit.

The movable support unit may include a first elastic support member disposed under the mount of the position fixing unit for elastically supporting the mount and a second elastic support member disposed on the door in the vicinity of the hook for elastically supporting the second part of the transfer unit.

The first elastic support member may include at least one mount slider disposed under the mount; at least one mount boss disposed on the door for slidably supporting the mount slider, and at least one mount spring disposed between the mount slider and the mount boss for elastically supporting the mount slider. The mount slider may include a first cylindrical part having at least one first elastic rib with first slits disposed at both sides thereof. The first elastic rib may have a first sliding projection formed on an outer surface thereof. The mount boss may include a second cylindrical part having at least one first sliding groove for slidably receiving the first elastic rib.

The second elastic support member may include at least one supporting plate slider having a supporting plate for supporting the second part of the transfer unit, at least one supporting plate boss disposed on the door for slidably supporting the supporting plate slider, and at least one supporting plate spring disposed between the supporting plate slider and the supporting plate boss for elastically supporting the supporting plate slider. The supporting plate slider may include a third cylindrical part having at least one second elastic rib with second slits disposed at both sides thereof. The second elastic rib may have a second sliding projection formed on an outer surface thereof. The supporting plate boss may include a fourth cylindrical part having at least one second sliding groove for slidably receiving the second sliding projection of the second elastic rib.

The transfer unit-fixing apparatus may further comprise a relative position fixing unit to maintain a relative position between the transfer unit and photoconductive body units disposed in a main body of the image forming device, when the door is closed. The relative position fixing unit may include at least one locking boss disposed on the second part of the second part of the transfer unit, and at least one locking member disposed on a frame in the main body for receiving and locking the locking boss therein. The locking member may include a lever rotatably disposed on the frame and having a locking end formed in a shape corresponding to the locking boss to engage therewith, and an elastic spring for urging the lever into engagement with the locking boss. The locking boss may have a locking projection formed on an outer surface thereof, and the locking end of the lever may be formed in a shape corresponding to the locking projection.

According to another exemplary embodiment, an image forming device comprises a main body having a frame, at least one door for opening and closing the main body, at least one photoconductive body unit having a photoconductive body on which a toner image is formed, a transfer unit to transfer the toner image formed on the photoconductive body, and a transfer unit-fixing apparatus for fixing the transfer unit to the door. The transfer unit-fixing apparatus comprises a position fixing unit for pivotally supporting and mounting a first part of the transfer unit on the door, and a locking unit for locking a second part of the transfer unit to the door.

The position fixing unit may include at least one fixing boss disposed on the first part of the transfer unit, and at least one mount disposed on the door for receivably and rotatably supporting the fixing boss. The mount may be a U-shaped member with a hinge groove. The hinge groove may have anti-escape projections formed at an inlet thereof to prevent the fixing boss from escaping from the hinge groove.

The locking unit may include at least one hook disposed on the door, and at least one hook hanger disposed opposite the hook on the second part of the transfer unit.

The transfer unit-fixing apparatus may further comprise a movable support unit for elastically supporting the transfer unit.

The movable support unit may include a first elastic support member disposed under the mount of the position fixing unit for elastically supporting the mount and a second elastic support member disposed on the door in the vicinity of the hook for elastically supporting the second part of the transfer unit.

The first elastic support member may include at least one mount slider disposed under the mount; at least one mount boss disposed on the door for slidably supporting the mount slider, and at least one mount spring disposed between the mount slider and the mount boss for elastically supporting the mount slider. The mount slider may include a first cylindrical part having at least one first elastic rib with first slits disposed at both sides thereof. The first elastic rib may have a first sliding projection formed on an outer surface thereof. The mount boss may include a second cylindrical part having at least one first sliding groove for slidably receiving the first elastic rib.

The second elastic support member may include at least one supporting plate slider having a supporting plate for supporting the second part of the transfer unit, at least one supporting plate boss disposed on the door for slidably supporting the supporting plate slider, and at least one supporting plate spring disposed between the supporting plate slider and the supporting plate boss for elastically supporting the supporting plate slider. The supporting plate slider may include a third cylindrical part having at least one second elastic rib with second slits disposed at both sides thereof. The second elastic rib may have a second sliding projection formed on an outer surface thereof. The supporting plate boss may include a fourth cylindrical part having at least one second sliding groove for slidably receiving the second sliding projection of the second elastic rib.

The transfer unit-fixing apparatus may further comprise a relative position fixing unit to maintain a relative position between the transfer unit and photoconductive body units disposed in a main body of the image forming device, when the door is closed. The relative position fixing unit may include at least one locking boss disposed on the second part of the second part of the transfer unit, and at least one locking member disposed on a frame in the main body for receiving and locking the locking boss therein. The locking member may include a lever rotatably disposed on the frame and having a locking end formed in a shape corresponding to the locking boss to engage therewith, and an elastic spring for urging the lever into engagement with the locking boss. The locking boss may have a locking projection formed on an outer surface thereof, and the locking end of the lever may be formed in a shape corresponding to the locking projection.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

A transfer unit-fixing apparatus and an image forming device having the same according to an exemplary embodiment of the present invention will now be described in greater detail with reference to the accompanying drawings.

Figure 1:
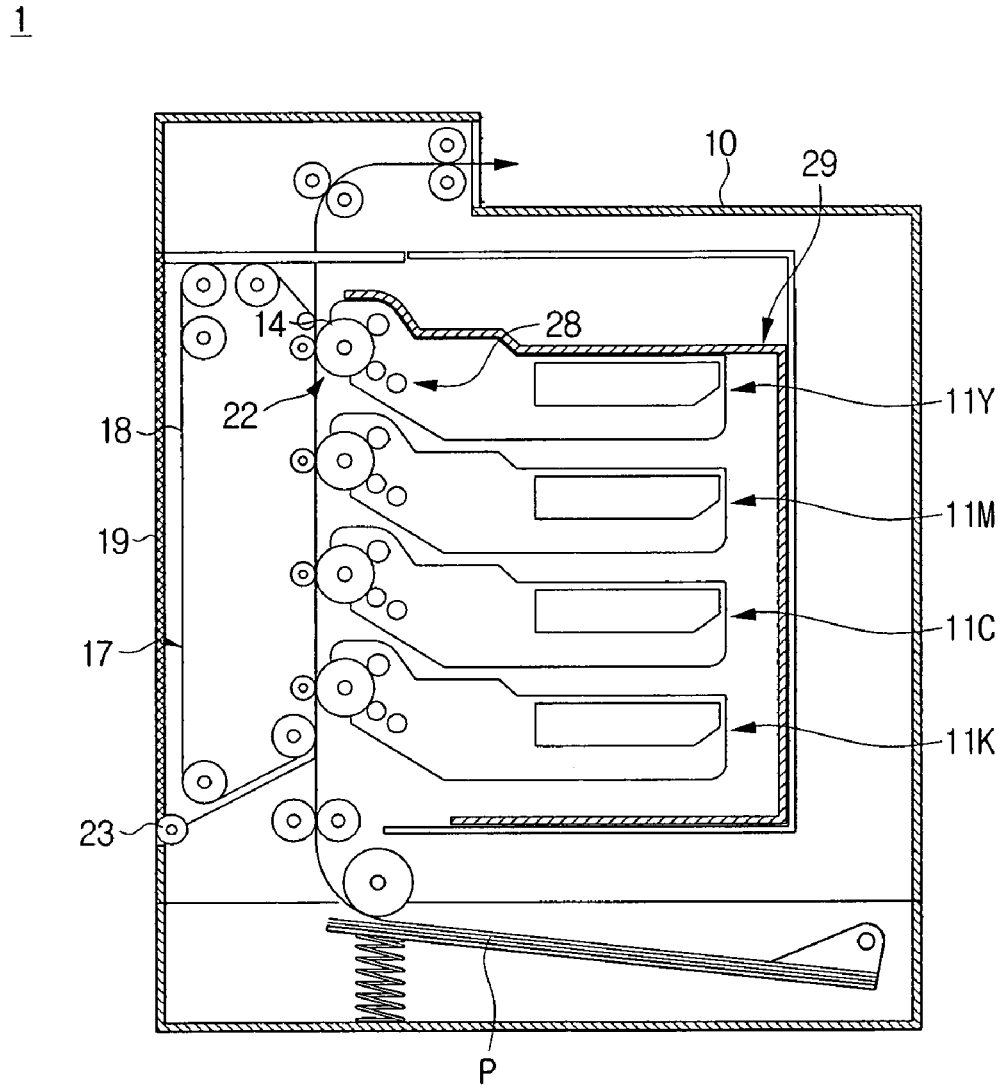
FIG. 1 (PRIOR ART)
FIG. 1 is a schematic side elevational view of a conventional tandem color laser printer.
Figure 2:
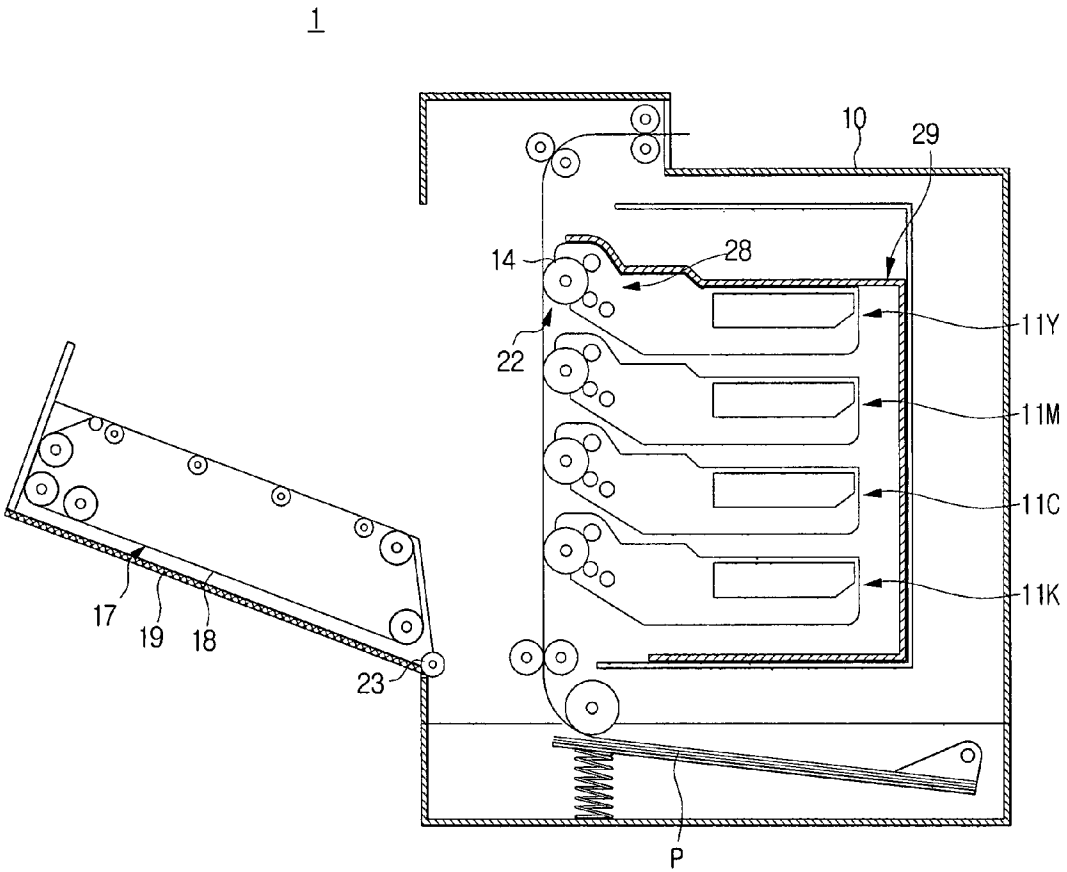
FIG. 2 (PRIOR ART)
FIG. 2 is a schematic side elevational view of the tandem color laser printer of FIG. 1 in which a door is opened.
Figure 3:
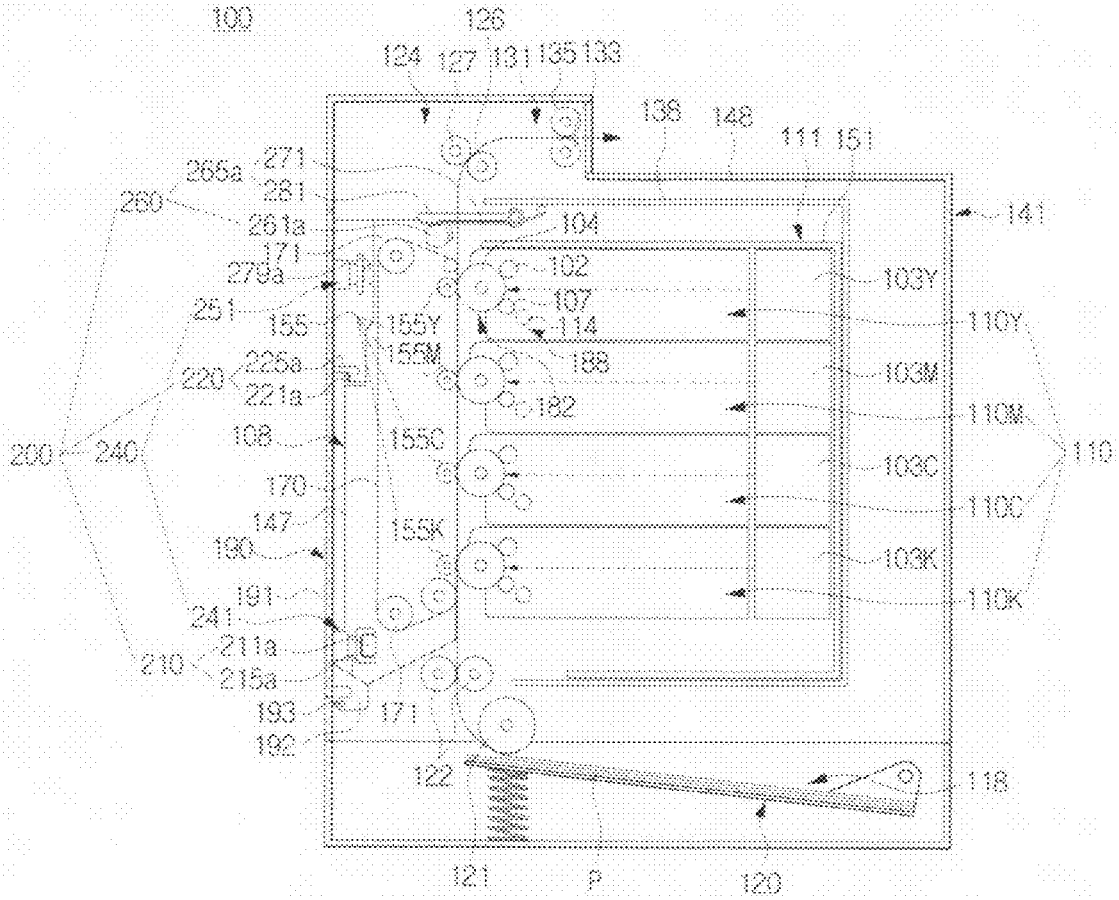
FIG. 3 is a schematic side elevational view of a tandem color laser printer with a transfer unit-fixing apparatus in accordance with an exemplary embodiment of the present invention.

FIG. 3 schematically illustrates an image forming device with a transfer unit-fixing apparatus according to an exemplary embodiment of the present invention.

In this exemplary embodiment, the image forming device is a tandem color laser printer 100 that print and output data input from an external device such as PC.

The tandem color laser printer 100 according to an exemplary embodiment of the present invention comprises a main body 141, a paper feeding unit 118, a cartridge frame 111, a cartridge unit 110, a transfer unit 108, a transfer unit-fixing apparatus 200, a fusing unit 124, and a paper discharge unit 131.

The main body 141 has a main frame 138, and a door 190, which is able to open and close the inside of the main body 141 for repair and maintenance.

The door 190 is provided with a door frame 191, which is rotatably fixed on the main body 141 through a rotation axis 193 formed on a rotary bracket 192. A handle (not shown) is formed on an outer surface of the door frame 191 to open and close the door 190.

To lock the door 191 on the main body 141, a conventional locking unit (not shown) is disposed at an appropriate position between the door frame 191 and the main frame 138.

The paper feeding unit 118, which supplies a recording medium P such as a sheet of printing paper, comprises a paper feeding cassette 120, a pickup roller 121, and a conveyance and backup roller 122. The paper feeding cassette 120, the pickup roller 121, and the conveyance and backup roller 122 are conventional, and, therefore, a detailed description will be omitted for the sake of brevity.

The cartridge frame 111, which holds the cartridge unit 110, is disposed above the paper feeding unit 118.

The cartridge frame 111 comprises a rectangular chest body 151 in which the cartridge unit 110 is disposed.

The cartridge unit 110 comprises first, second, third, and fourth cartridges 110Y, 110M, 110C, and 110K, which are vertically arranged at certain intervals.

The first through fourth cartridges 110Y through 110K form color toner images such as yellow, magenta, cyan, and black toner images.

Since the first through fourth cartridges 110Y through 110K have the same general construction, only the first cartridge 110Y will be described in detail for the sake of brevity.

Figure 5A:
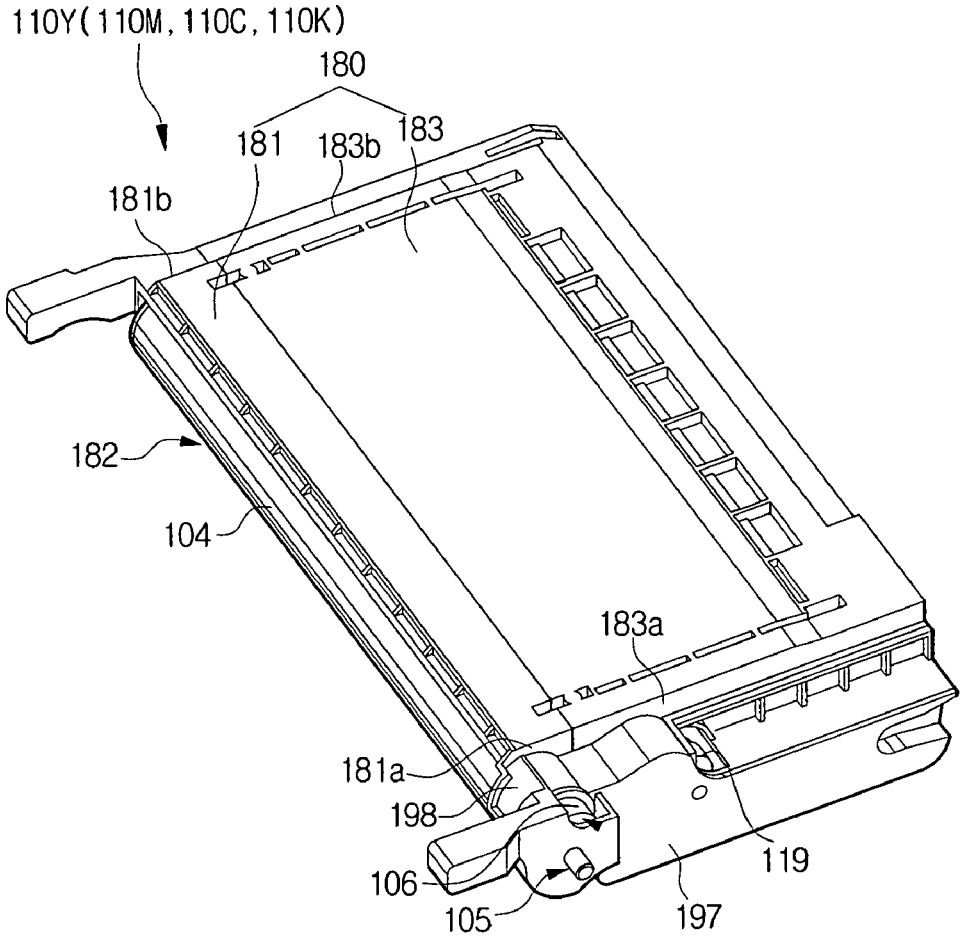
FIGS. 5A and 5B are a perspective view and a side elevational view of a yellow cartridge of the tandem color laser printer of FIG. 3.
Figure 5B:
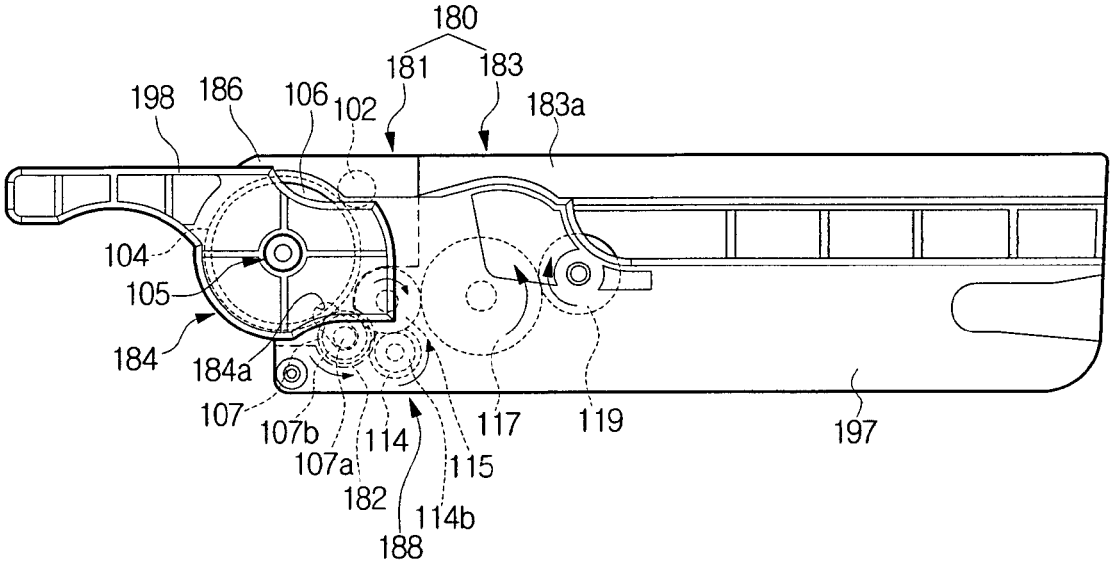

As illustrated in FIGS. 5A and 5B, the first cartridge 110Y comprises a photoconductive body unit 182, a developing unit 188, and a housing 180 integrating the above-mentioned components as a single module unit.

The photoconductive body unit 182 comprises a photoconductive body 104 that is rotatably supported in a photoconductive body casing 181. The photoconductive body 104 is an organic photoconductive (OPC) drum.

As illustrated in FIG. 5B, a charging roller 102 for charging the surface of the photoconductive body 104 and a photoconductive body cleaner (not shown) for removing waste developer remaining on the surface of the photoconductive body 104 are disposed at predetermined positions on the outer circumference of the photoconductive body 104 in a rotation direction. Since the charging roller 102 and the photoconductive body cleaner are substantially identical to those of a conventional image forming device, detailed descriptions of the components will be omitted for clarity and conciseness.

The developing unit 188 comprises a developing roller 107 that is disposed in a developing casing 183 to face the photoconductive body 104 with a constant gap therebetween, a supplying roller 114 for supplying the developing roller 107 with a developer, and a developer regulation blade (not shown) for regulating the thickness of a developer layer formed on the developing roller 107. Since the developing roller 107, the supplying roller 114, and the developer regulation blade are substantially identical to those of a conventional image forming device, detailed descriptions of the components will be omitted for clarity and conciseness.

The housing 180 comprises a photoconductive body casing 181 and a developing casing 183.

The photoconductive body casing 181 comprises first and second lateral frames 181*a* and 181*b*, which support shafts of the components of the photoconductive body unit 182, for example, shafts of the photoconductive body 104 and the charging roller 102, and a first lateral cover 198 for sealing a first driven gear 106 disposed on an outer surface of the first lateral frame 181*a*.

The developing casing 183 comprises first and second lateral frames 183*a* and 183*b*, which support shafts of the components of the developing unit 188, for example, shafts of the developing roller 107, the supplying roller 114, a driving force transmission gear 115, a deceleration gear 117, and a second driven gear 119, and a second lateral cover 197 for sealing a developing roller gear 107*b*, a supplying roller gear 114*b*, the driving force transmission gear 115, the deceleration gear 117, and the second driven gear 119 which are disposed on an outer surface of the first lateral frame 183*a*.

The photoconductive body casing 181 and the developing casing 183 are connected to each other via a slide groove 184*a* and a fixing hole (not shown) of a fixing part (not shown). The slide groove 184*a* is formed in a lower portion 184 of the first lateral frame 181*a* of the photoconductive body casing 181 to receive the developing roller shaft 107*a*, and the fixing hole is formed at a rear (the left in the drawings) portion of the second lateral frame 183*b* of the developing casing 183 to receive and rotatably support a second end portion (not shown) of the photoconductive body shaft 105.

Referring again to FIGS. 3 and 4, first, second, third and fourth laser scanning units 103Y, 103M, 103C, and 103K are respectively arranged to scan the corresponding photoconductive bodies 104 with laser beams via corresponding slots (not shown) which are formed in the middle of the photoconductive body casing 181 and the developing casing 183 in front (the right in the drawings) of the developing casing 183 in the rectangular chest body 151. Each of the first through fourth laser scanning units 103Y through 103K irradiates laser beams toward the surface of the corresponding photoconductive body 104 charged by the corresponding charging roller 102 by using a laser diode, according to an image signal input from an external device such as a PC, and thereby forms an electrostatic latent image for a corresponding color toner image such as a yellow, magenta, cyan, or black toner image.

Here, the first through fourth laser scanning units 103Y through 103K are illustrated and explained as though they are independent from the first through fourth cartridges 110Y, 110M, 110C, and 110K. The scanning units may also be integrated into the developing casing 183 of the developing unit 188 as a module unit, respectively.

The transfer unit 108 transfers toner images formed on the photoconductive bodies 104 of the photoconductive body units 182 of the first through the fourth cartridges 110Y to 110K onto the recording medium P, and is integrally formed with the door 190 to be opened and closed along with the door 190.

The transfer unit 108 comprises a medium conveying belt 170, a transfer part 155, and a transfer housing 147 integrating the above-mentioned components as a single module unit. The medium conveying belt 170 is rotatably supported by a plurality of rollers 171 supported on the transfer housing 147. The transfer part 155 comprises first, second, third, and fourth transfer rollers 155Y, 155M, 155C, 155K that are arranged in the transfer housing 147 to face the photoconductive bodies 104 of the photoconductive body units 182 of the first through the fourth cartridges 110Y through 110K. The first through fourth transfer rollers 155Y through 155K elastically press the photoconductive bodies 104 of the photoconductive body units 182 of the first through the fourth cartridges 110Y through 110K with a predetermined pressure to give a predetermined pressure to the recording medium P. Also, the first through the fourth transfer rollers 155Y through 155K are supplied with a predetermined level of transfer voltage to transfer the toner images from the photoconductive bodies 104 of the photoconductive body units 182 of the first through the fourth cartridges 110Y through 110K onto the recoding medium P.

The transfer unit-fixing apparatus 200, which fixes the transfer unit 108 to the door 190 thereby to integrally form therewith, comprises a position fixing unit 210 and a locking unit 220.

Figure 6A:
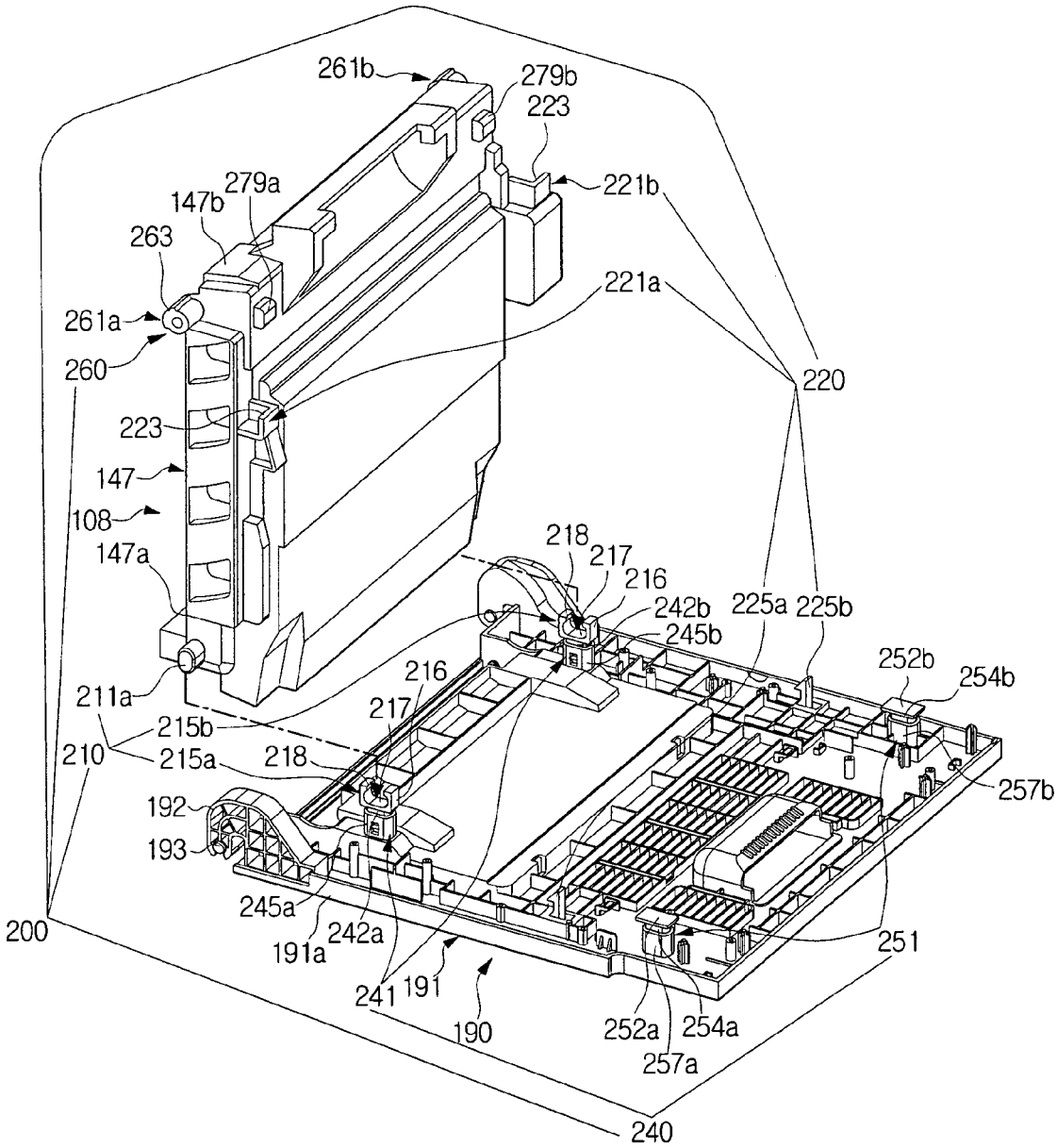
FIGS. 6A, 6B and 6C are an exploded-perspective view, an exploded side elevational view, and an assembled side elevational view illustrating a relation between the door and a transfer unit of the tandem color laser printer of FIG. 3 which are assembled to each other by the transfer unit-fixing apparatus in accordance with an exemplary embodiment of the present invention.
Figure 6B:
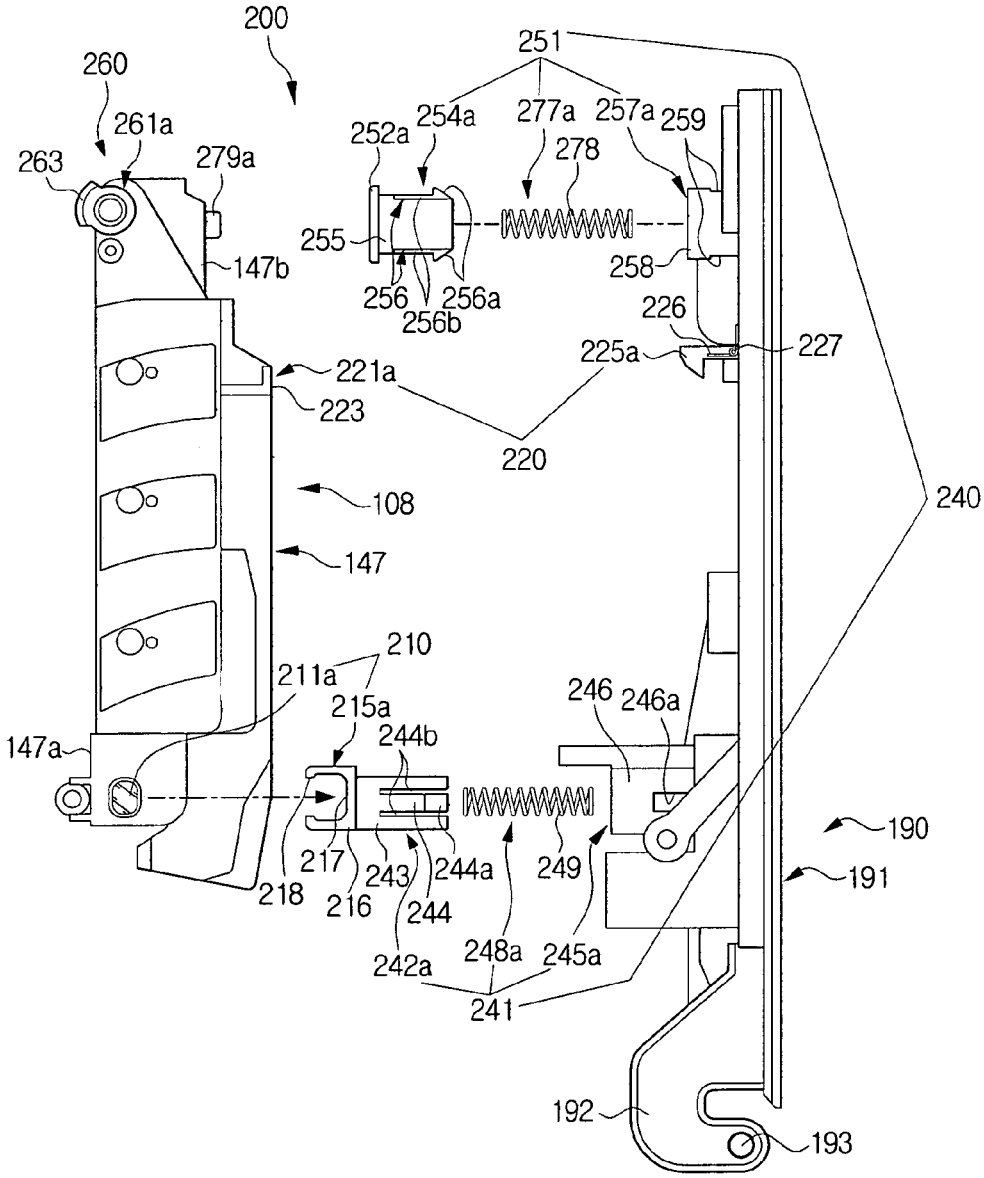
Figure 6C:
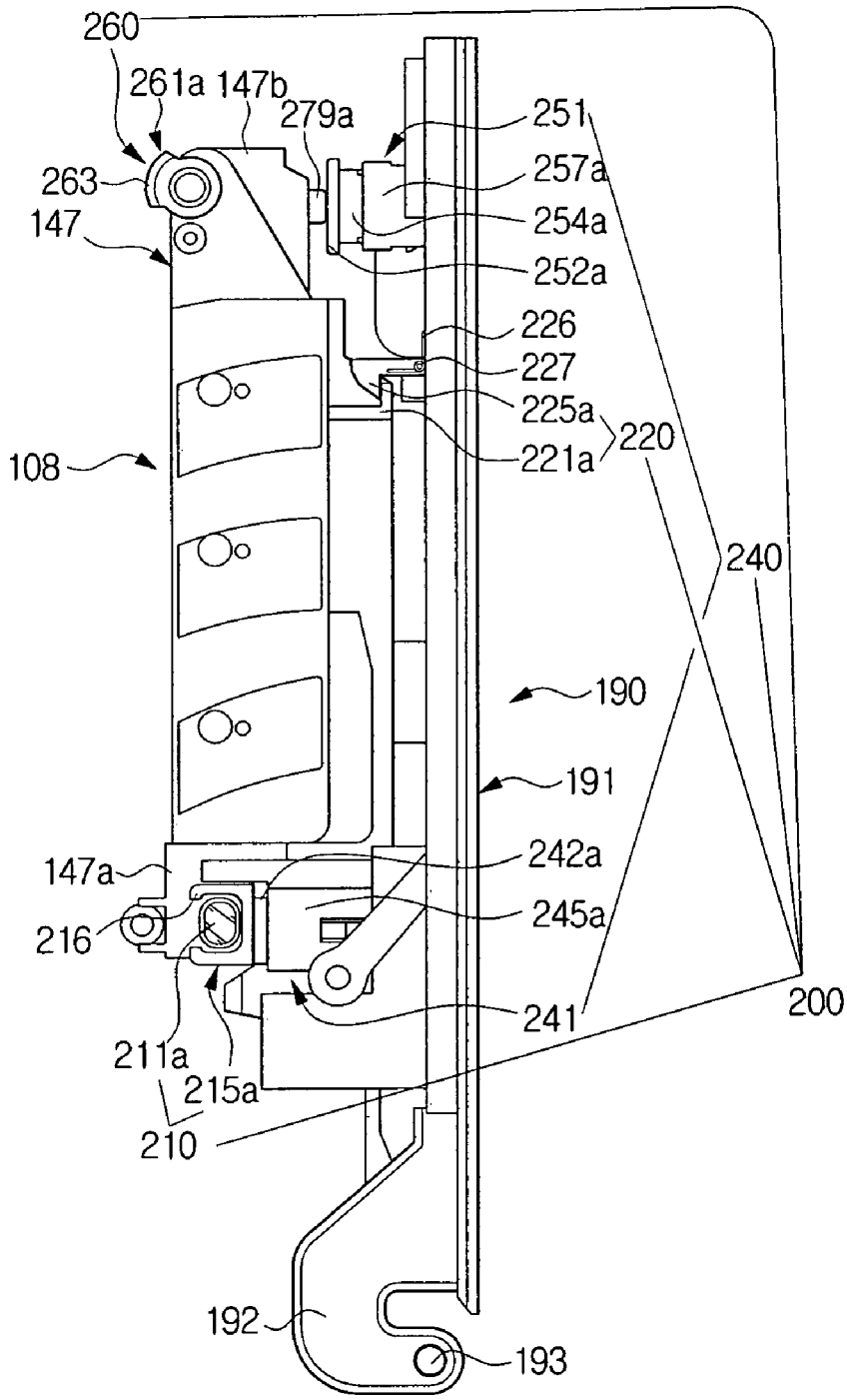

As illustrated in FIGS. 6A through 6C, the position fixing unit 210 is provided with first and second fixing bosses 211*a* (only one shown) that protrude from both side surfaces of a first part, for example, a lower end 147*a*, of the transfer housing 147 of the transfer unit 108.

First and second mounts 215*a* and 215*b* are formed opposite to the first and second fixing bosses 211*a* at an inner surface of the door frame 191. The first and second mounts 215*a* and 215*b*, which receive and rotatably support the first and second fixing bosses 211*a*, are respectively formed of U-shaped members 216. Each of the U-shaped members 216 has a hinge groove 217. The hinge groove 217 has anti-escape projections 218 formed at an inlet thereof to prevent the first or second fixing bosses 211*a* from escaping from the hinge groove 217 after it is inserted therein.

The locking unit 220, which locks a second part, i.e., an upper end 147*b*, of the transfer housing 147 on the door frame 191, comprises first and second hooks 225*a* and 225*b*, and first and second hook hangers 221*a* and 221*b*.

The first and second hooks 225*a* and 225*b* are disposed at both sides of the inner surface of the door frame 191 to be spaced apart from each other. Each of the first and second hooks 225*a* and 225*b* is rotatable about a rotation axis 227, and is biased toward an upright position by an elastic spring 226 (see FIGS. 6B and 6C).

The first and second hook hangers 221*a* and 221*b* are respectively composed of L-shaped members 223 formed opposite to the first and second hooks 225*a* and 225*b* on the upper end 147*b* of the transfer housing 147.

The operation of fixing and assembling the transfer unit 108 to the door 190 through the position fixing unit 210 and the locking unit 220 constructed as described above will now be described in detail.

First, as illustrated in FIG. 6A, the first and second fixing bosses 211*a* formed at both side surfaces of the lower end 147*a* of the transfer housing 147 are aligned with the hinge grooves 217 of the U-shaped members 216 of the first and second mounts 215*a* and 215*b*.

Subsequently, the first and second fixing bosses 21 la are pressed past the anti-escape projections 218, so that they are inserted into the hinge grooves 217. As a result, the transfer unit 108 is positioned on the door frame 191, and the lower end 147*a* of the transfer housing 147 is pivotally supported on the door frame 191 by the first and second fixing bosses 211*a* and the first and second mounts 215*a* and 215*b*.

Thereafter, the transfer housing 147 is rotated at an angle of about 90° toward the door frame 191, i.e., in a clockwise direction of FIG. 6A, about the first and second fixing bosses 211*a* formed at both side surfaces of the lower end 147*a* of the transfer housing 147.

As a result, as illustrated in FIG. 6C, the first and second hook hangers 221*a* and 221*b* located at the upper end 147*b* of the transfer housing 147 push front ends of the first and second hooks 225*a* and 225*b* backward against an elastic force of the torsion spring 226, and then come to be locked in the front ends of the first and second hooks 225*a* and 225*b*.

When the first and second hook hangers 221*a* and 221*b* are locked in the front ends of the first and second hooks 225*a* and 225*b*, the first and second hooks 225*a* and 225*b* are maintained in a locking position by the torsion spring 226, and the operation of assembling the transfer unit 108 to the door 190 is completed.

As described above, since the transfer unit-fixing apparatus 200 has the position fixing unit 210 to pivotally support the lower end 147*a* of the transfer housing 147 on the door frame 191 and the locking unit 220 to fix the upper end 147*b* of the transfer housing 147 to the door frame 191, the transfer unit 108 can be easily assembled to and disassembled from the door 190. Thus, the printer 100 can be easily assembled, maintained and repaired.

To elastically support the transfer unit 108 on the door 190, the transfer unit-fixing apparatus 200 further comprises a movable support unit 240.

The movable support unit 240 is composed of first and second elastic support members 241 and 251.

The first elastic support member 241 elastically supports the U-shaped member 216 of the first and second mounts 215*a* and 215*b* under the U-shaped member 216, and thereby elastically supports the lower end 147*a* of the transfer housing 147.

As illustrated in FIGS. 6A and 6B, the first elastic support member 241 is provided with first and second mount sliders 242*a* and 242*b*, which are respectively formed under the first and second mounts 215*a* and 215*b*. Each of the first and second mount sliders 242*a* and 242*b* is composed of a first cylindrical part 243 having two first elastic ribs 244 (only one shown) formed to be a circumferentially spaced-apart from each other. Each of the first elastic ribs 244 has a first sliding projection 244*a* formed on an outer surface thereof. Also, each of the first elastic ribs 244 has an elastic force by first slits 244*b* formed in the first cylindrical part 243 at both sides thereof.

The first and second mount sliders 242*a* and 242*b* are slidably supported on first and second mount bosses 245*a* and 245*b* which are respectively disposed corresponding to the first and second mount sliders 242*a* and 242*b* on the inner surface of the door frame 191. Each of the first and second mount bosses 245*a* and 245*b* is composed of a second cylindrical part 246 having two first sliding grooves 246*a* (only one shown) formed to slidably receive the first sliding projections 244*a* of the first elastic ribs 244.

First and second mount springs 248*a* (only one shown in FIG. 6B) are disposed between the first and second mount sliders 242*a* and 242*b* and the first and second mount bosses 245*a* and 245*b* to elastically support the first and second mount sliders 242*a* and 242*b* on the first and second mount bosses 245*a* and 245*b*. Each of the first and second mount springs 248*a* is preferably a compression spring 249.

The elastic force of the first and second springs 248*a* is set, so that the medium conveying belt 170 of the transfer unit 108 can be pressed at a predetermined pressure against the photoconductive bodies 104 of the photoconductive body units 182 of the cartridges when the door 190 having the transfer unit 108 assembled thereto is closed, and thereby to form predetermined nips between the medium transfer belt 170 and the photoconductive bodies 104.

The second elastic support member 251 is formed on the inner surface of the door frame 191 in the vicinity of the first and second hooks 225*a* and 225*b* of the locking unit 220 to elastically support the upper end 147*b* of the transfer unit 147.

The second elastic support member 251 is provided with first and second supporting plate sliders 254*a* and 254*b* having first and second supporting plates 252*a* and 252*b*, respectively. The first and second supporting plate sliders 254*a* and 254*b* are disposed opposite to first and second supporting projections 279*a* and 279*b*, so that the first and second supporting plates 252*a* and 252*b* can support the first and second supporting projections 279*a* and 279*b*. The first and second supporting projections 279*a* and 279*b* are formed on both sides of a lower surface of the upper end 147*b* of the transfer housing 147.

Each of the first and second supporting plate sliders 254*a* and 254*b* is composed of a third cylindrical part 255 having two second elastic ribs 256 formed to be a circumferentially spaced-apart from each other. Each of the second elastic ribs 256 has a second sliding projection 256*a* formed on an outer surface thereof. Also, each of the second elastic ribs 256 has an elastic force by second slits 256*b* formed in the second cylindrical part 255 at both sides thereof.

The first and second supporting plate sliders 254*a* and 254*b* are slidably supported in first and second supporting plate bosses 257*a* and 257*b* disposed on the inner surface of the door frame 191.

Each of the first and second supporting plate bosses 245*a* and 245*b* is composed of a third cylindrical part 258 having two second sliding grooves 259 formed to slidably receive the second sliding projections 256*a* of the second elastic ribs 256.

First and second supporting plate springs 277*a* (only one shown) are disposed between the first and second supporting plate sliders 254*a* and 254*b* and the first and second supporting plate bosses 257*a* and 257*b* to elastically support the first and second supporting plate sliders 254*a* and 254*b* on the first and second supporting plate bosses 257*a* and 257*b*. Each of the first and second supporting plate springs 277*a* is preferably formed of a compression spring 278.

The elastic force of the first and second supporting plate springs 277*a* is set so that the medium transfer belt 170 of the transfer unit 108 can be pressed at a predetermined pressure against the photoconductive bodies 104 of the photoconductive body units 182 of the cartridges when the door 190 having the transfer unit 108 assembled thereto is closed, and thereby to form predetermined nips between the medium transfer belt 170 and the photoconductive bodies 104.

As described above, the transfer unit-fixing apparatus 200 has the first elastic support member 241 to elastically support the first and second mounts 215*a* and 215*b* and thereby to elastically the lower end 147*a* of the transfer housing 147, and the second elastic support member 251 to elastically support the first and second supporting plates 252*a* and 252*b* and thereby to elastically the upper end 147*b* of the transfer housing 147. Accordingly, even though the door 190 having the transfer unit 108 assembled thereto and the cartridge frame 111 having the first through fourth cartridges 110Y through 110K mounted therein are not accurately manufactured due to manufacturing tolerances and the like, or are twisted due to contractions or expansions caused by external forces or changes in the environment when the door 190 is closed, the medium conveying belt 170 of the transfer unit 108 and the photoconductive bodies 104 of the photoconductive body units 182 of the first through fourth cartridges 110Y and 110K can be maintained in contact with each other at a predetermined pressure and thereby form predetermined nips therebetween. As a result, image defects such as jitter, mis-registration, skew and the like are prevented from being produced due to changes in pressure and the nip between the medium transfer belt 170 and the photoconductive bodies 104.

Figure 4:
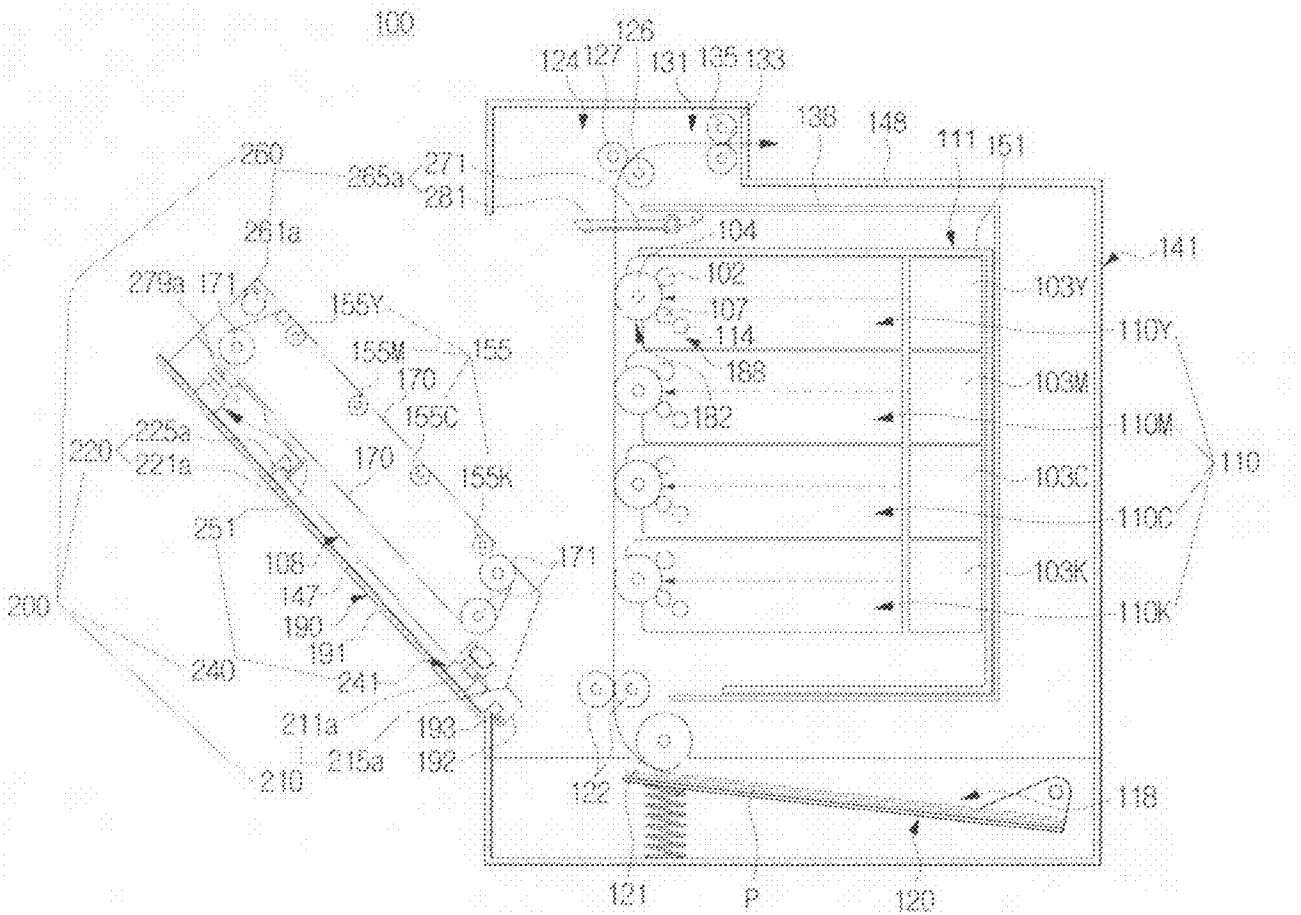
FIG. 4 is a schematic side elevational view of the tandem color laser printer of FIG. 3 in which a door is opened.
Figure 7:
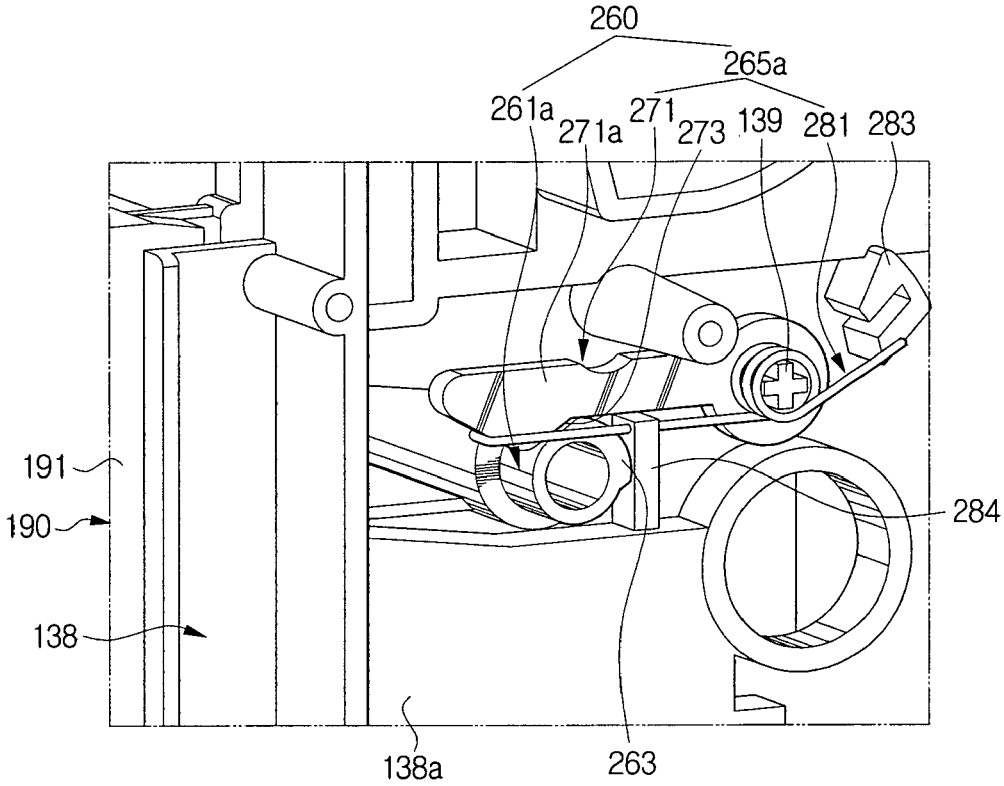
FIG. 7 is a partial perspective view of a relative position fixing unit of the transfer unit-fixing apparatus of the tandem color laser printer shown in FIG. 3.

Also, as illustrated in FIGS. 3, 4 and 7, the transfer unit-fixing apparatus 200 may further comprise a relative position fixing unit 260 to maintain a fixed relative position between the transfer unit 108 and photoconductive body units 182 of the first through fourth cartridges 110Y through 110K when the door 190 is closed.

The relative position fixing unit 260 includes first and second locking bosses 261*a* and 261*b* (see FIG. 6A) and first and second locking members 265*a* (only one shown, see FIG. 3).

The first and second locking bosses 261*a* and 261*b* project from both sides of the upper end 147*b* of the transfer housing 147. Semicircular locking projections 263 are formed on a circumference of each of the first and second locking bosses 261*a* and 261*b*.

As illustrated in FIGS. 3 and 7, first and second locking members 265*a* are formed opposite to the first and second locking bosses 261*a* and 261*b* at a left sidewall (not shown) and an right sidewall 138*a* (see FIG. 7) to receive and lock the first and second locking bosses 261*a* and 261*b* when the door 190 is closed.

Each of the first and second locking members 265*a* is provided with a locking lever 271 rotatably disposed on a fixing axis 139 which is formed at the left sidewall or the right sidewall 138*a* of the main frame 138, and an elastic spring 281 to urge the locking lever 271 to be maintained at a position which engages with the first or second locking boss 261*a* or 261*b*. The locking lever 271 has a locking end 271*a* with a recess 273 formed in a shape corresponding to the semicircular locking projection 263 of the first or second locking boss 261*a* or 261*b* to engage therewith. The elastic spring 281 may be a torsion spring which is disposed on the fixing axis 139. The elastic spring 281 has one end fixed to a spring support 283 formed at the left side wall or the right sidewall 138*a*, and the other end is fixed to the locking end 271*a* of the locking lever 271, passing through a supporting bracket 284. The supporting bracket 284 supports the other end of the elastic spring 281 and maintains the locking lever 271 in a horizontal position.

Accordingly, when the door 190 is pushed by the handle to be rotated clockwise from a position illustrated in FIG. 4 and closed, the locking projections 263 of the first and second locking bosses 261*a* and 261*b*, which protrude from both side surfaces of the upper end 147*b* of the transfer housing 147, pushes up the locking end 271*a* of the locking lever 271 against the elastic force of the elastic spring 281, and then comes to be inserted and locked in the recess 273 of the locking end 271*a*, as illustrated in FIG. 7. As a result, the door 190 can be maintained at a closed position as illustrated in FIG. 3, and the upper end 147*b* of the transfer housing 147 can be maintained at a predetermined position with respect to the photoconductive body units 182 of the respective cartridges 110Y through fourth 110K.

In contrast, when the door 190 is pulled by the handle to be rotated counterclockwise from a position shown in FIG. 3 and opened, the locking projections 263 of the first and second locking bosses 261*a* and 261*b* push up the locking end 271*a* of the locking lever 271 against the elastic force of the elastic spring 281, and are released and separated from the recess 273 of the locking end 271*a*. As a result, the door 190, together with the transfer unit 108 assembled thereto, is opened.

As described above, the relative position fixing unit 260 maintains the upper end 147*b* of the transfer housing 147 at a predetermined position relative to the photoconductive body units 182 of the respective cartridges 110Y through fourth 110K when the door 190 is closed. Accordingly, the relative position between the transfer unit 108 and the photoconductive body units 182 can not be substantially changed, and the relative position is stably maintained even though the door frame 191 and the like is not accurately manufactured due to a manufacture tolerances and the like, or due to vibrations and the like generated by external or internal causes during image forming operation. As a result, image defects such as jitter, mis-registration, a skew and the like are prevented from being produced due to a change in the relative position between the transfer unit 108 and the photoconductive body units 182.

Also, since the relative position fixing unit 260 is provided with the first and second locking bosses 261*a* and 261*b* formed at the upper end 147*b* of the transfer housing 147 and the first and second locking member 265*a*, it can function to fix the door frame 191 having the transfer housing 147 mounted thereon to the main frame 138, as well as to maintain the upper end 147*b* of the transfer housing 147 at the predetermined position relative to the photoconductive units 182. Accordingly, the printer 100 of an exemplary implementation of the present invention does not require a locking unit disposed between the door 190 and the main body 141 to lock the door 190 on the main body 141.

Referring back to FIGS. 3 and 4, the fusing unit 124, which fuses the toner images onto the recording medium P, comprises a heating roller 126 and a pressing roller 127. The heating roller 126 has a heater (not shown) disposed therein to fuse the toner images onto the recording medium P with high temperature heats. The pressing roller 127 is pressed against the heating roller 126 by an elastic pressing device (not shown) to apply pressure to the recording medium P.

The discharge unit 131 discharges the recording medium P where the toner images are fused to a discharge tray 148, and comprises a discharge roller 133 and a backup roller 135.

Although the above-described image forming device with the transfer unit-fixing apparatus in accordance with exemplary embodiments of the present invention is a tandem color laser printer 100 comprising the transfer unit 108 having the medium conveying belt 170 to directly transfer toner images formed on the photoconductive bodies 104 of the photoconductive body units 182 in the first through fourth cartridges 110Y through 110K onto the recording medium P, the present invention is applicable to other types of image forming apparatuses, and this should not be considered as limiting. For example, the present invention can be applied to a tandem color laser printer with an intermediate transfer unit having a transfer drum or a transfer belt disposed between the transfer unit 108 and the photosensitive bodies 104 of the photoconductive body units 182. In this case, the toner images formed on the photosensitive bodies 104 are not directly transferred to the recording medium P, but first transferred as a first transfer image onto the transfer belt and then retransferred from the transfer belt onto the recording medium P.

The operation of the above-described tandem color laser printer 100 employing the transfer unit-fixing apparatus 200 according to an exemplary embodiment of the present invention is substantially identical to the operation of a conventional image forming device. Thus, a detailed description of the operation is omitted for the sake of brevity.

According to the exemplary embodiment of the present invention as described above, the transfer unit-fixing apparatus and the image forming device employing the same have a position fixing unit to pivotally support the lower end of the transfer housing on the door frame and a locking unit to fix the upper end of the transfer housing to the door frame. Accordingly, the transfer unit can be easily assembled to or disassembled from the door, so that the printer can be easily assembled, maintained and repaired.

Further, according to the exemplary embodiment of the present invention as described above, the transfer unit-fixing apparatus and the image forming device employing the same has a movable support unit to elastically support the transfer unit on the door. Accordingly, even though the door having the transfer unit assembled thereto and the cartridge frame having the plurality of cartridges mounted therein are not accurately manufactured due to manufacturing tolerances and the like, or are twisted due to contractions or expansions caused by external forces or changes in the environment, the medium conveying belt of the transfer unit and the photoconductive bodies of the photoconductive body units of the cartridges can be maintained in contact with each other at a predetermined pressure and form predetermined nips therebetween. As a result, image defects such as jitter, mis-registration, skew and the like are prevented from being produced due to changes in pressure and changes in the nip between the medium transfer belt and the photoconductive bodies.

Also, according to the exemplary embodiment of the present invention as described above, the transfer unit-fixing apparatus and the image forming device employing the same has a relative position fixing unit to maintain the relative position between the transfer unit and photoconductive body units when the door is closed. Accordingly, even though the door frame and the like is not accurately manufactured due to manufacturing tolerances and the like, or due to vibration and the like generated by external or internal causes in the image forming operations of the printer, the relative position between the transfer unit and the photoconductive body units is substantially fixed and maintained. As a result, image defects such as jitter, mis-registration, skew and the like are prevented from being produced due to changes in the relative position between the transfer unit and the photoconductive body units.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A transfer unit-fixing apparatus for fixing a transfer unit to a door of an image forming device, comprising:

a position fixing unit for pivotally supporting and mounting a first part of the transfer unit on the door;

a locking unit for locking a second part of the transfer unit to the door; and a movable support unit for elastically supporting the transfer unit to the door in a direction in which the door is in contact with the transfer unit;

wherein the movable support unit comprises a first elastic support member disposed on the door for elastically supporting the second part of the transfer unit.

2. The transfer unit-fixing apparatus as claimed in claim 1, wherein the position fixing unit comprises:

at least one fixing boss disposed on the first part of the transfer unit; and at least one mount disposed on the door for receiving and rotatably supporting the fixing boss.

3. The transfer unit-fixing apparatus as claimed in claim 2, wherein the at least one mount comprises a U-shaped member with a hinge groove, the hinge groove comprising anti-escape projections at an inlet thereof to prevent the fixing boss from escaping from the inlet of the hinge groove.

4. The transfer unit-fixing apparatus as claimed in claim 2, wherein the locking unit comprises:

at least one hook disposed on the door; and at least one hook hanger disposed on the second part of the transfer unit for receiving the at least one hook.

5. The transfer unit-fixing apparatus as claimed in claim 1, wherein the movable support unit further comprises a second elastic support member disposed under the mount of the position fixing unit for elastically supporting the mount and the first part of the transfer unit;

wherein the first elastic support member is disposed on the door in the vicinity of the hook.

6. The transfer unit-fixing apparatus as claimed in claim 5, wherein the second elastic support member comprises:

at least one mount slider disposed under the mount;

at least one mount boss disposed on the door for slidably supporting the mount slider; and at least one mount spring disposed between the mount slider and the mount boss for elastically supporting the mount slider.

7. The transfer unit-fixing apparatus as claimed in claim 1, further comprising a relative position fixing unit to maintain a relative position between the transfer unit and photoconductive body units disposed in a main body of the image forming device when the door is closed.

8. The transfer unit-fixing apparatus as claimed in claim 7, wherein the relative position fixing unit comprises:

at least one locking boss disposed on the second part of the transfer unit; and at least one locking member disposed on a frame in the main body for receiving and locking the locking boss therein.

9. The transfer unit-fixing apparatus as claimed in claim 8, wherein the locking member comprises:

a lever rotatably disposed on the frame, the lever comprising a locking end formed in a shape corresponding to the locking boss to engage therewith; and an elastic spring for urging the lever into engagement with the locking boss.

10. The transfer unit-fixing apparatus as claimed in claim 9, wherein the locking boss comprises a locking projection formed on an outer surface thereof; and the locking end of the lever comprises a shape corresponding to the shape of the locking projection.

11. The transfer unit-fixing apparatus as claimed in claim 1, wherein the first elastic support member comprises:

at least one supporting plate slider disposed against the second part of the transfer unit;

at least one supporting plate boss slidably supporting the supporting plate; and at least one supporting plate spring.

12. A transfer unit-fixing apparatus for fixing a transfer unit to a door of an image forming device, comprising:

a position fixing unit for pivotally supporting and mounting a first part of the transfer unit on the door, the position fixing unit comprising at least one fixing boss disposed on the first part of the transfer unit and at least one mount disposed on the door for receiving and rotatably supporting the fixing boss;

a locking unit for locking a second part of the transfer unit to the door, the locking unit comprising at least one hook disposed on the door; and a movable support unit for elastically supporting the transfer unit to the door;

wherein the movable support unit comprises:

a first elastic support member disposed under the mount of the position fixing unit for elastically supporting the mount and the first part of the transfer unit; and a second elastic support member disposed on the door in the vicinity of the hook for elastically supporting the second part of the transfer unit;

the first elastic support member comprises:

at least one mount slider disposed under the mount;

at least one mount boss disposed on the door for slidably supporting the mount slider; and at least one mount spring disposed between the mount slider and the mount boss for elastically supporting the mount slider;

the mount slider comprises a first cylindrical part comprising at least one first elastic rib with first slits disposed at both sides thereof, the first elastic rib comprising a first sliding projection formed on an outer surface thereof; and the mount boss comprises a second cylindrical part having at least one first sliding groove for slidably receiving the first sliding projection of the first elastic rib.

13. A transfer unit-fixing apparatus for fixing a transfer unit to a door of an image forming device, comprising:

a position fixing unit for pivotally supporting and mounting a first part of the transfer unit on the door, the position fixing unit comprising at least one fixing boss disposed on the first part of the transfer unit and at least one mount disposed on the door for receiving and rotatably supporting the fixing boss;

a locking unit for locking a second part of the transfer unit to the door, the locking unit comprising at least one hook disposed on the door; and a movable support unit for elastically supporting the transfer unit to the door;

wherein the movable support unit comprises:

a first elastic support member disposed under the mount of the position fixing unit for elastically supporting the mount and the first part of the transfer unit; and a second elastic support member disposed on the door in the vicinity of the hook for elastically supporting the second part of the transfer unit; and the second elastic support member comprises:

at least one supporting plate slider comprising a supporting plate for supporting the second part of the transfer unit;

at least one supporting plate boss disposed on the door for slidably supporting the supporting plate slider; and at least one supporting plate spring disposed between the supporting plate slider and the supporting plate boss for elastically supporting the supporting plate slider.

14. The transfer unit-fixing apparatus as claimed in claim 13, wherein the supporting plate slider comprises a third cylindrical part comprising at least one second elastic rib with second slits disposed at both sides thereof, the second elastic rib comprising a second sliding projection formed on an outer surface thereof; and the supporting plate boss comprises a fourth cylindrical part having at least one second sliding groove for slidably receiving the second sliding projection of the second elastic rib.

15. An image forming device comprising:

a main body having a frame;

at least one door for opening and closing the main body;

at least one photoconductive body unit comprising a photoconductive body on which a toner image is formed;

a transfer unit for transferring the toner image formed on the photoconductive body; and a transfer unit-fixing apparatus to integrally fix the transfer unit to the door, the transfer unit-fixing apparatus comprising:

a position fixing unit for pivotally supporting and mounting a first part of the transfer unit on the door;

a locking unit for locking a second part of the transfer unit to the door; and a movable support unit for elastically supporting the transfer unit to the door in a direction in which the door is in contact with the transfer unit;

wherein the movable support unit comprises a first elastic support member disposed on the door for elastically supporting the second part of the transfer unit.

16. The image forming device as claimed in claim 15, wherein the position fixing unit comprises:

at least one fixing boss disposed on the first part of the transfer unit; and at least one mount disposed on the door for receiving and rotatably supporting the fixing boss.

17. The image forming device as claimed in claim 16, wherein the locking unit comprises:

at least one hook disposed on the door; and at least one hook hanger disposed on the second part of the transfer unit for receiving the at least one hook.

18. The transfer unit-fixing apparatus as claimed in claim 15, wherein the movable support unit comprises a second elastic support member disposed under the mount of the position fixing unit for elastically supporting the mount and the first part of the transfer unit;

wherein the second elastic support member is disposed on the door in the vicinity of the hook.

19. The image forming device as claimed in claim 18, wherein the second elastic support member comprises:

at least one mount slider disposed under the mount;

at least one mount boss disposed on the door to slidably support the mount slider; and at least one mount spring disposed between the mount slider and the mount boss to elastically support the mount slider.

20. The image forming device as claimed in claim 15, further comprising a relative position fixing unit to maintain a relative position between the transfer unit and photoconductive body units disposed in a main body of the image forming device when the door is closed.

21. The image forming device as claimed in claim 20, wherein the relative position fixing unit comprises:

at least one locking boss disposed on the second part of the transfer unit; and at least one locking member disposed on a frame in the main body for receiving and locking the locking boss therein.

22. The image forming device as claimed in claim 21, wherein the locking member comprises:

a lever rotatably disposed on the frame, the lever comprising a locking end formed in a shape corresponding to the locking boss to engage therewith; and an elastic spring for urging the lever into engagement with the locking boss.

23. The transfer unit-fixing apparatus as claimed in claim 15, wherein the first elastic support member comprises:

at least one supporting plate slider disposed against the second part of the transfer unit;

at least one supporting plate boss slidably supporting the supporting plate; and at least one supporting plate spring.

24. An image forming device comprising:

a main body having a frame;

at least one door for opening and closing the main body;

at least one photoconductive body unit comprising a photoconductive body on which a toner image is formed;

a transfer unit for transferring the toner image formed on the photoconductive body;

a movable support unit for elastically supporting the transfer unit to the door; and a transfer unit-fixing apparatus to integrally fix the transfer unit to the door, the transfer unit-fixing apparatus comprising:

a position fixing unit for pivotally supporting and mounting a first part of the transfer unit on the door, the position fixing unit comprising at least one fixing boss disposed on the first part of the transfer unit, and at least one mount disposed on the door for receiving and rotatably supporting the fixing boss; and a locking unit for locking a second part of the transfer unit to the door, the locking unit comprising at least one hook disposed on the door;

wherein the movable support unit comprises:

a first elastic support member disposed under the mount of the position fixing unit for elastically supporting the mount and the first part of the transfer unit; and a second elastic support member disposed on the door in the vicinity of the hook for elastically supporting the second part of the transfer unit;

the first elastic support member comprises:

at least one mount slider disposed under the mount;

at least one mount boss disposed on the door to slidably support the mount slider; and at least one mount spring disposed between the mount slider and the mount boss to elastically support the mount slider;

the mount slider comprises a first cylindrical part comprising at least one first elastic rib with first slits disposed at both sides thereof, the first elastic rib comprising a first sliding projection formed on an outer surface thereof; and the mount boss comprises a second cylindrical part having at least one first sliding groove for slidably receiving the first sliding projection of the first elastic rib.

25. An image forming device comprising:

a main body having a frame;

at least one door for opening and closing the main body;

at least one photoconductive body unit comprising a photoconductive body on which a toner image is formed;

a transfer unit for transferring the toner image formed on the photoconductive body;

a movable support unit for elastically supporting the transfer unit to the door; and a transfer unit-fixing apparatus to integrally fix the transfer unit to the door, the transfer unit-fixing apparatus comprising:

a position fixing unit for pivotally supporting and mounting a first part of the transfer unit on the door the position fixing unit comprising at least one fixing boss disposed on the first part of the transfer unit, and at least one mount disposed on the door for receiving and rotatably supporting the fixing boss; and a locking unit for locking a second part of the transfer unit to the door the locking unit comprising at least one hook disposed on the door;

wherein the movable support unit comprises:

a first elastic support member disposed under the mount of the position fixing unit for elastically supporting the mount and the first part of the transfer unit; and a second elastic support member disposed on the door in the vicinity of the hook for elastically supporting the second part of the transfer unit; and the second elastic support member comprises:

at least one supporting plate slider comprising a supporting plate for supporting the second part of the transfer unit;

at least one supporting plate boss disposed on the door for slidably supporting the supporting plate slider; and at least one supporting plate spring disposed between the supporting plate slider and the supporting plate boss for elastically supporting the supporting plate slider.

26. The image forming device as claimed in claim 25, wherein the supporting plate slider comprises a third cylindrical part comprising at least one second elastic rib with second slits disposed at both sides thereof, the second elastic rib comprising a second sliding projection formed on an outer surface thereof; and the supporting plate boss comprises a fourth cylindrical part having at least one second sliding groove for slidably receiving the second sliding projection of the second elastic rib.

* * * * *